United States Patent [19]

Konomi

[11] 4,006,718

[45] Feb. 8, 1977

[54] MISFIRE DETECTION SYSTEM FOR AN INTERNAL COMBUSTION ENGINE

[75] Inventor: Toshiaki Konomi, Susono, Japan

[73] Assignee: Toyota Jidosha Kogyo Kabushiki Kaisha, Japan

[22] Filed: May 20, 1974

[21] Appl. No.: 471,558

[30] Foreign Application Priority Data

May 31, 1973 Japan ..... 48-60312

[52] U.S. Cl. ..... 123/32 EA; 60/276

[51] Int. Cl.² ..... F02M 51/00

[58] Field of Search ..... 123/119 E, 32 EA, 198 D; 60/276, 277; 73/117.3

[56] References Cited

UNITED STATES PATENTS

| | | | |
|---|---|---|---|
| 3,670,565 | 6/1972 | Paulson | 60/277 |
| 3,738,108 | 6/1973 | Goto et al. | 60/277 |
| 3,782,347 | 1/1974 | Schmidt et al. | 60/276 X |
| 3,831,563 | 8/1974 | Brittain et al. | 123/32 EA |
| 3,851,469 | 12/1974 | Eichler et al. | 60/277 |
| 3,875,907 | 4/1975 | Wessel et al. | 123/32 EA |

*Primary Examiner*—Wendell E. Burns
*Assistant Examiner*—David D. Reynolds
*Attorney, Agent, or Firm*—Toren, McGeady and Stanger

[57] ABSTRACT

A misfire detection system for an internal combustion engine is arranged to generate a first signal indicative of the oxygen concentration in the exhaust gas. Such first signal, whose instantaneous value is normally employed to adjust the engine fuel supply to control its air-to-fuel ratio, is additionally employed to interrupt the supply of fuel and secondary air to the engine when the first signal remains above a prescribed level after the elapse of a prescribed duration of the fuel supply adjustment.

5 Claims, 4 Drawing Figures

MISFIRE DETECTION SYSTEM FOR AN INTERNAL COMBUSTION ENGINE

BACKGROUND OF THE INVENTION

The invention relates to a misfire detection system for an internal combustion engine, particularly of the type equipped with a catalytic converter for cleaning the exhaust gas.

Generally, when the engine misfire occurs in a vehicle equipped with a catalytic converter, the resultant large quantity of unburned combustion components which are discharged through the exhaust greatly increases the reaction heat of the catalyst. Such excessive heat, if unchecked, leads to deterioration or breakdown of the catalyst and in some cases to a fire accident of the vehicle.

Such effects can be partially avoided by employing known techniques based on the principle that engine misfires of this type cause an increase in the catalyst bed temperature or the exhaust gas temperature. In such techniques, an electrical indication triggered upon the overheating of one of these parameters is employed either to interrupt the fuel and secondary air supplies to the engine or to effect a bypass of the exhaust gas from its normal route through the converter.

One disadvantage of prior art schemes of this type is that the excess temperature sensing facilities operate too late to effect efficient correction of the defect, since overheating of a large portion of the catalyst has already occurred. Moreover, even if the overheating of the bed or gas is detected in time, the inertial time lags of the correcting system may cause the latter to respond too late to prevent destruction of the catalyst by heat.

SUMMARY OF THE INVENTION

These disadvantages are overcome with the improved misfire detection system of the invention, whose operation is based on the principle that oxygen concentration in the exhaust gas increases when misfire occurs. In an illustrative embodiment, facilities are provided which detect the presence of such oxygen concentration increase long before the temperature of the catalyst and/or the exhaust gas has risen to dangerous levels.

A first signal indicative of the normal level of the oxygen concentration of the exhaust gas is employed to adjust the fuel supply to the engine to maintain a relatively constant air-to-fuel ratio. When the first signal remains above a given level after the completion of a prescribed duration of such fuel supply adjustment, a second signal indicative of engine misfire is generated. Such second signal, in turn, illustratively operates an arrangement that prevents overheating of the catalyst by interrupting the fuel and secondary air supplies.

A feature of the invention is that the second signal generating means may be inhibited from operation when the engine is cold or when the temperature of the catalyst is lower than its normal reaction-starting temperature.

BRIEF DESCRIPTION OF THE DRAWING

The invention is further set forth in the following detailed description taken in conjunction with the appended drawing, in which.

DETAILED DESCRIPTION

Figure 1:
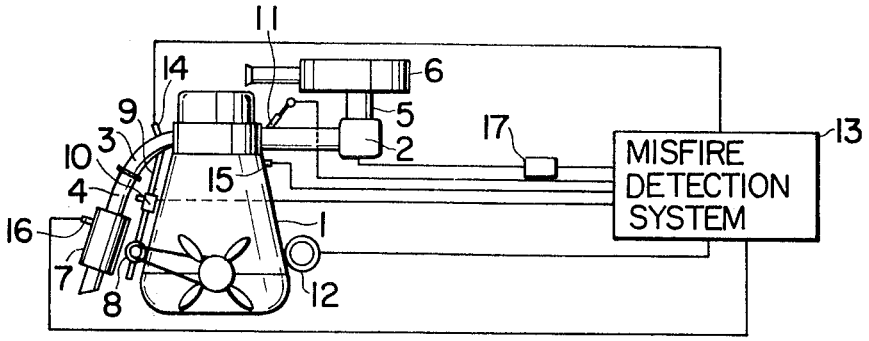
FIG. 1 is a pictorial diagram of an internal combustion engine provided with misfire detection facilities in accordance with the invention.

Referring now to the drawing, FIG. 1 shows schematically an internal combustion engine having a main engine body 1. The engine is provided with conventional fuel and primary air supply facilities including an air cleaner 6, a carburetor 5, an intake manifold 2 and a fuel injection device 11. The exhaust portion of the engine includes an exhaust manifold 3 associated with an exhaust pipe 4, a catalytic converter 7 in such exhaust pipe, and an arrangement for supplying secondary air to the exhaust manifold 3. Such latter arrangement includes an air pump 8 for selectively impelling such secondary air into the exhaust manifold through an air manifold 9. A bypass valve 10 is associated with the manifold 9 for selectively shutting off supply of the secondary air into the manifold 3. A starter motor 12 for the engine 1 is also depicted.

Figure 2:
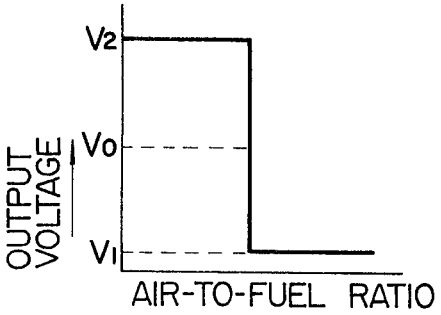
FIG. 2 is a curve showing a typical responsive characteristic of a sensing device employed to detect oxygen concentration in the exhaust gas of the engine of FIG. 1.

A misfire detection system 13 embodied by an electronic control unit is coupled to various sensors associated with the engine 1. For purposes of the invention a primary sensor, designated as 14, is arranged to yield a first voltage indicative of the oxygen concentration of the exhaust gas passing through the exhaust manifold 3. Such first voltage is normally employed to regulate the engine fuel supply to control its air to fuel ratio. The output characteristic of the sensor 14 is shown in FIG. 2; as indicated, such sensor is preset to yield a relatively high voltage output $V_2$ when the air-to-fuel ratio of the engine is higher than a predetermined value and a relatively low voltage level $V_1$ when such air-to-fuel ratio is lower than the predetermined value. Since engine misfire is associated with unburned combustion components, the sensor 14 will in general exhibit the value $V_2$ over a relatively long interval upon the occurrence of a misfire in the engine.

The system 13 is also coupled to the output of (1) a negative pressure sensor 17 associated with the intake manifold 2; (2) a sensor 15 whose output is indicative of the temperature of the engine coolant; (3) a sensor 16 indicative of the temperature of the exhaust gas (or, if desired, the temperature of the catalyst); and (4) a sensor associated with the starter 12.

Figure 3:
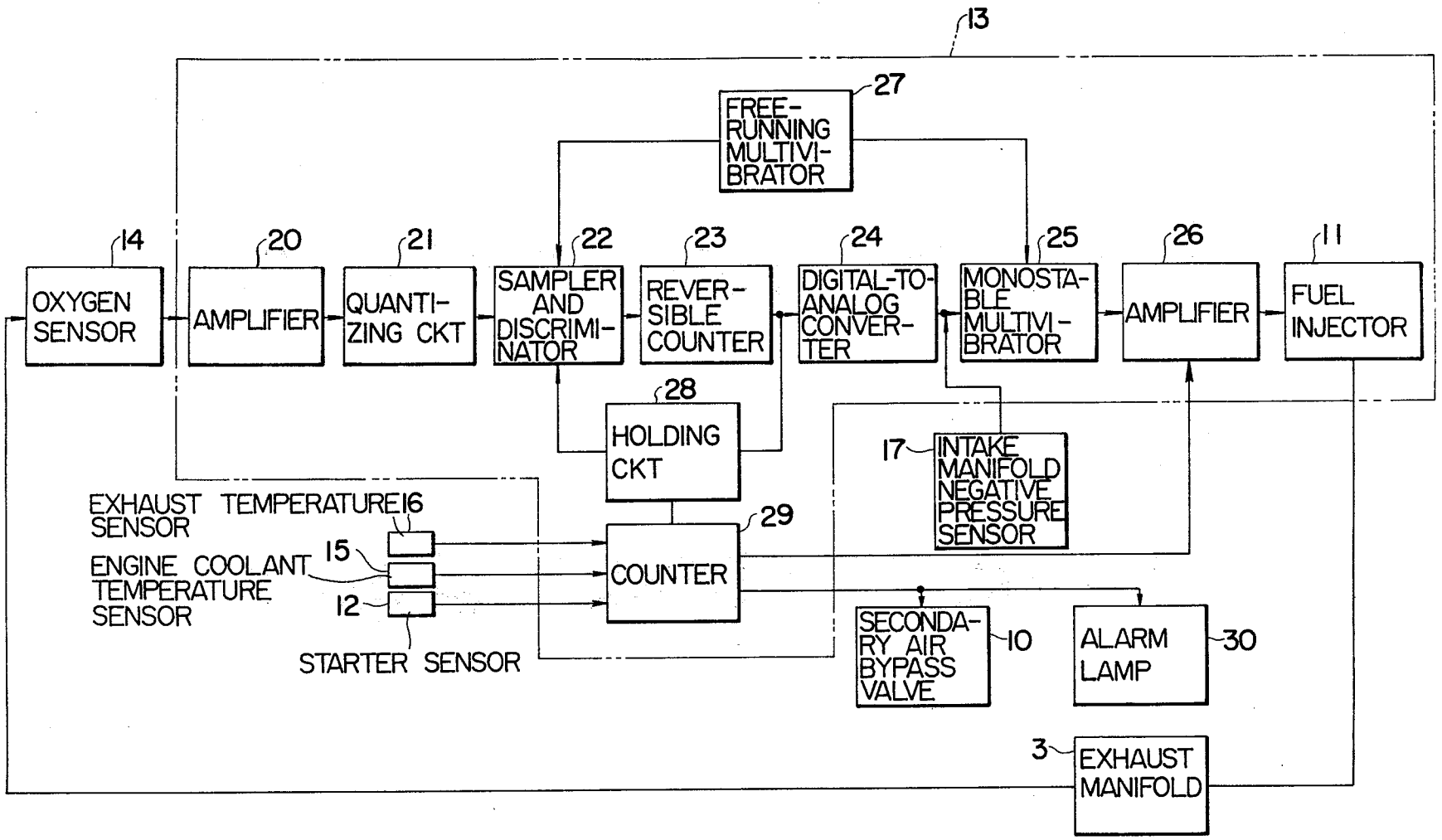
FIG. 3 is a detailed block diagram of the misfire detection system of FIG. 1.

An illustrative arrangement of the misfire detection system 13 is shown in FIG. 3. The output voltage of the sensor 14 is coupled through an amplifier 20 to the input of a quantization circuit 21. The circuit 21 yields a first binary value, illustratively a binary 1, when the voltage output of the sensor 14 is at the level $V_2$ and a second binary value illustrative of a binary 0, when such output voltage is at the level $V_1$. The output of the circuit 21 is sampled at a clock rate in a sampling and discrimination circuit 22, the clock pulses of which are supplied by a free-running multivibrator 27. A reversible counter 23 is coupled to the output of the sampling circuit 22 in such a manner that the counter is incremented in the forward direction upon the occurrence of each binary 1 sample and incremented in the reverse direction upon the occurrence of each binary 0 sample.

A holding circuit 28 coupling the output of counter 23 to an input of circuit 22 prevents the counter 23 from overflowing and resetting to zero when incremented beyond its limit in the forward direction, and from regressing beyond zero to its maximum value when incremented beyond its limit in the reverse direction. In particular, the holding circuit is arranged so that when the sensor 14 maintains the value $V_2$ over a large number of sampling periods (so that the sampling circuit 22 continues to apply binary 1's to the counter 23 after the upper limit of such counter in the forward direction has been reached), such additional binary 1's will be accumulated in a second counter 29 while the reversible counter 23 maintains its limit condition.

The output of the reversible counter 23 is applied to a digital-to-analog converter 24, which in turn excites a monostable multivibrator 25. The input of the multivibrator 25 is also coupled to the output of the sensor 17, which is employed to adjust the width of the pulse at the output of the multivibrator 25. The output of such multivibrator 25, which is also excited by the free-running multivibrator 27, is coupled through a normally conductive amplifier 26 to a valve (not shown) of the injector 11. Such valve in turn is opened during successive sampling periods to pass fuel to the engine for a duration determined by the instantaneous width of the then-occurring output pulse from the multivibrator 25.

In summary, the circuit shown in FIG. 3 operates to convert the occurrence of an excess of oxygen concentration in the exhaust, as sensed by the sensor 14, into a command to the fuel injector 11 to supply more fuel to the engine to maintain the air-fuel ratio at the desired level; thus, as additional fuel is called for in any given sampling period, the valve of the fuel injector is maintained open for correspondingly greater time and vice versa.

In the event of a misfire, i.e. when the voltage level $V_2$ indicative of a large oxygen concentration in the exhaust gas is maintained by the sensor 14 for an excessive number of successive sampling intervals, the cooperation of the reversible counter 23, the holding circuit 28, and the counter 29 will cause the counter 29 to be incremented by the succession of binary 1's from the discrimination circuit 22 beyond the number necessary to fill the counter 23. When the resulting count of the counter 29 has reached a prescribed value, the counter 29 outpulses a disabling signal to the amplifier 26 to prevent the application of pulses from the output of the multivibrator 25 to the fuel injector 11, so that the latter will be prevented from supplying the fuel to the engine. Simultaneously, the output of the counter 29 provides an excitation signal to the secondary air bypass valve 10 to stop the flow of secondary air to the exhaust manifold 3, and to trigger an alarm 30 to indicate the occurrence of the engine misfire to an operator.

In order to prevent the above-described system 13 from operating under unsuitable conditions (e.g., when a cold engine is being started or when the catalyst temperature is lower than a desired reaction-starting temperature), the above-described sensors 12, 15 and 16 are coupled to the counter 29 to inhibit the operation of such counter during the occurrence of an output signal from any of such sensors. Accordingly, the counter 29 will be inhibited from initiating the shut-off of the fuel and secondary air supplies from the engine during the occurrence of any of the following conditions associated with the sensors 12, 15, and 16: (1) when the vehicle is started, (2) when the temperature of the engine coolant is below a prescribed value, and (3) when the temperature of the catalyst is below the prescribed reaction-starting value.

Figure 4:
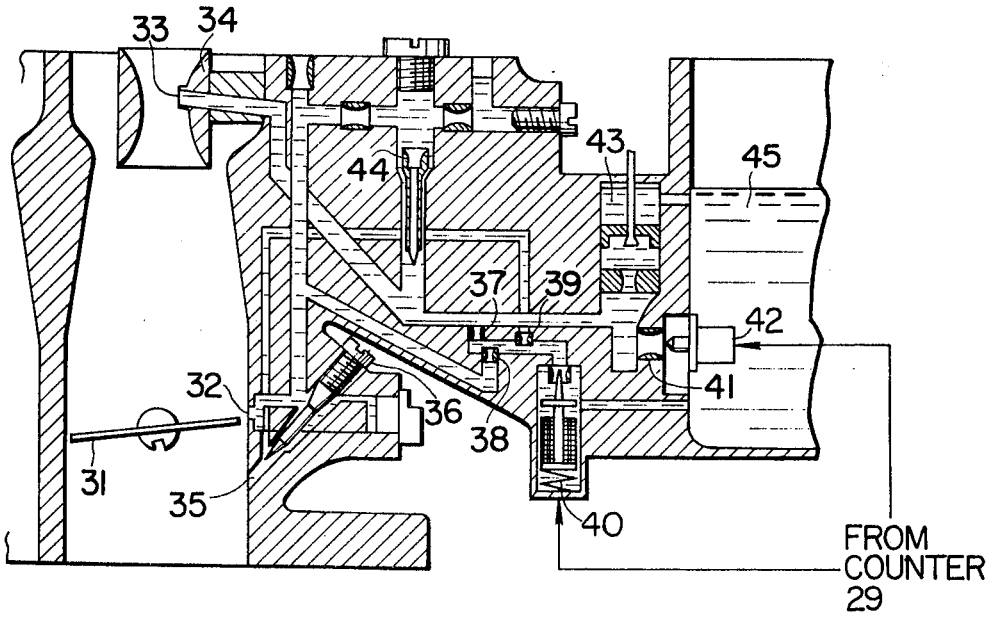
FIG. 4 is an elevation view, in section, of a carburetor whose fuel supply jets are controllable by means of the misfire detection system of FIG. 3.

A suitable carburetor that may be associated with the misfire detection circuit 13 of FIG. 3 is shown in FIG. 4. The carburetor includes a plurality of conventional facilities including a throttle valve 31, a throw portion 32, a primary nozzle 33 and a primary Venturi 34. Also depicted are an idle adjusting screw 36, distributing jets 37, 38 and 39 controlled by a solenoid valve 40, a primary main jet 41 controlled by a solenoid valve 42, a power system 43, a primary slow jet 44 and a float chamber 45. In this embodiment, the output disabling signal from the counter 29 is directly effective to close the solenoid valves 40 and 42, thereby disabling the primary jets to shut off the fuel supply to the engine. (If desired, appropriate secondary jets of the carburetor may also be coupled to the counter 29.)

The above-described system, wherein an engine misfire is detected according to the value of the oxygen concentration in the exhaust gas, provides a quicker response than conventional detection systems that rely on the detection of the overheating of the catalyst bed and for the exhaust gas. Thus greater safety is insured with the present scheme against heat destruction of the catalyst and fire in the vehicle. Moreover, it will be noted that only a single main sensor 14 is required to provide operational input for the system 13, rather than the separate sensors associated normally in the prior art when both reducing catalysts and oxidizing catalysts are used. The additional incorporation of the above-described inhibiting means to prevent operation of the counter 29 during adverse operating conditions provides a further degree of protection.

In the foregoing, the invention has been described in connection with a preferred arrangement thereof. Many variations and modifications will now occur to those skilled in the art. It is accordingly desired that the scope of the appended claims not be limited to the specific disclosure herein contained.

What is claimed is:

1. In a misfire detection system adapted for use with an internal combustion engine having an exhaust portion and a fluid adjustment portion, comprising first generating means in an exhaust portion of an engine, and coupled to an adjustment portion for generating a first signal indicative of the oxygen concentration of exhaust gas from an engine to adjust the supply of a first fluid to an engine, and second generating means responsive when the first signal remains above a given value at the conclusion of a prescribed duration of such fluid supply adjustment for generating a second signal indicative of an engine misfire, means responsive to the first signal and operative at a sampling rate for generating a first binary value whenever the first signal is above the given value and a second binary value whenever such first signal is below the given value; a reversible counter; means for incrementing the counter in one of two opposite directions upon each occurrence of the first and second binary values, respectively, means rendered effective when the counter has been incremented to the limiting value associated with a prescribed direction for thereafter separately accumulating subsequent occurrences of the corresponding binary value; and means rendered effective when a predetermined number of such subsequent additional occurrences of the corresponding binary value has been accumulated for producing the second signal.

2. In a misfire detection system adapted for use with an internal combustion engine and having facilities for sensing engine misfire by monitoring at least one parameter in an exhaust portion of the engine, the improvement which comprises said facilities having means for generating a first signal indicative of the oxygen concentration in an exhaust gas for adjusting the supply of a first fluid to an engine; means normally responsive when the first signal remains above a given value at the conclusion of a prescribed duration of such fluid supply adjustment for generating a second signal indicative of engine misfire; means for generating a blocking signal indicative of a first state of a prescribed parameter of the engine, and means rendered effective during the occurrence of the blocking signal for inhibiting the operation of the second signal generating means.

3. The improvement as defined in claim 2, in which the blocking signal generating means includes, means for generating a third signal upon the starting of the engine; means for generating a fourth signal when the temperature of the engine coolant is below a prescribed value; and means for generating a fifth signal when the temperature of the exhaust gas exceeds a predetermined value; and in which the inhibiting means comprises means rendered effective upon the occurrence of any of the third, fourth and fifth signals for disabling the second signal generating means.

4. A drive system for an automobile, comprising an internal combustion engine having an exhaust portion and a fluid adjustment portion, first generating means in the exhaust portion of the engine, said first generating means being coupled to the adjustment portion for generating a first signal indicative of the oxygen concentration of the exhaust gas from the engine to adjust a supply of a first fluid to the engine, and second generating means responsive when the first signal exceeds a given value for a period of time corresponding to a prescribed duration of such fluid supply adjustment for generating a second signal indicative of an engine misfire, means responsive to the first signal and operative at a sampling rate for generating a first binary value whenever the first signal is above the given value and a second binary value whenever such first signal is below the given value; a reversible counter; means for incrementing the counter in one of two opposite directions upon each occurrence of the first and second binary values, respectively, means rendered effective when the counter has been incremented to the limiting value associated with a prescribed direction for thereafter separately accumulating subsequent occurrences of the corresponding binary value; and means rendered effective when a predetermined number of such subsequent additional occurrences of the corresponding binary value has been accumulated for producing the second signal.

5. A motor vehicle, comprising a chassis, an internal combustion engine mounted in the chassis, said internal combustion engine having an exhaust portion and a fluid adjustment portion, first generating means in the exhaust portion of the engine, said first generating means being coupled to the adjustment portion for generating a first signal indicative of the oxygen concentration of exhaust gas from the engine for adjusting the supply of a first fluid to the engine, and second generating means responsive when the first signal exceeds a given value for a period of time corresponding to a prescribed duration of such fluid supply adjustment for generating a second signal indicative of an engine misfire, means responsive to the first signal and operative at a sampling rate for generating a first binary value whenever the first signal is above the given value and a second binary value whenever such first signal is below the given value; a reversible counter; means for incrementing the counter in one of two opposite directions upon each occurrence of the first and second binary values, respectively, means rendered effective when the counter has been incremented to the limiting value associated with a prescribed direction for thereafter separately accumulating subsequent occurrences of the corresponding binary value; and means rendered effective when a predetermined number of such subsequent additional occurrences of the corresponding binary value has been accumulated for producing the second signal.

* * * * *